United States Patent [19]

Yeh

[11] Patent Number: 5,048,897

[45] Date of Patent: Sep. 17, 1991

[54] SPARK-PRODUCING MECHANISM FOR WHEEL ASSEMBLY

[75] Inventor: Cheng S. Yeh, Taipei, Taiwan

[73] Assignee: Lucky Star Enterprise & Co., Ltd., Taipei, Taiwan

[21] Appl. No.: 459,197

[22] Filed: Dec. 29, 1989

[51] Int. Cl.[5] ..... A63C 17/22; B60B 19/00

[52] U.S. Cl. ..... 301/5.3; 301/5 R; 280/11.19

[58] Field of Search ..... 301/1, 5.3, 5.7, 5 R; 446/22, 23; 280/11.19

[56] References Cited

U.S. PATENT DOCUMENTS

| | | | |
|---|---|---|---|
| 1,790,423 | 1/1931 | Hooks | 301/5.7 X |
| 3,052,060 | 9/1962 | Wohlestrom | 446/22 |
| 4,394,037 | 7/1983 | Kuntz | 446/23 X |

FOREIGN PATENT DOCUMENTS

| | | | |
|---|---|---|---|
| 366115 | 1/1932 | United Kingdom | 446/23 |

*Primary Examiner*—Russell D. Stormer

*Attorney, Agent, or Firm*—Cushman, Darby & Cushman

[57] ABSTRACT

A spark-producing mechanism for wheel assembly comprises a plurality of flints, a fixing ring for the mounting of flints which closely fits to the shaft of the wheel, a grindstone which is inserted in the interior of the wheel. By rotating the wheel, the flints rub against the grindstone to produce sparks.

1 Claim, 3 Drawing Sheets

SPARK-PRODUCING MECHANISM FOR WHEEL ASSEMBLY

BACKGROUND OF THE INVENTION

This invention pertains to a spark-producing mechanism for wheel assembly, comprising a plurality of flints and a fixing ring for the mounting of the flints which closely fits to the shaft of a wheel. The flints come into contact with a grindstone which is inserted in the interior of the wheel. By rotating the wheel, the flints rub against the grindstone to produce sparks.

SUMMARY OF THE INVENTION

It is therefore a primary object of the present invention to provide a spark-producing mechanism for wheel assembly which utilizes the friction between the flints and the grindstone to produce sparks when the wheel is rotated.

A further object of the present invention is to provide a spark-producing mechanism for wheel assembly which is easily assembled and disassembled because of its simple structure.

Another object of the present invention is to provide a spark-producing mechanism for wheel assembly by which the sparks produced are absolutely safe.

These, and other objects and advantages of the present invention, will become more apparent from a consideration of the following detailed description of the preferred embodiments, when read in conjunction with the accompanying drawings.

DETAILED DESCRIPTION OF THE PREFERRED EMBODIMENT

Figure 1:
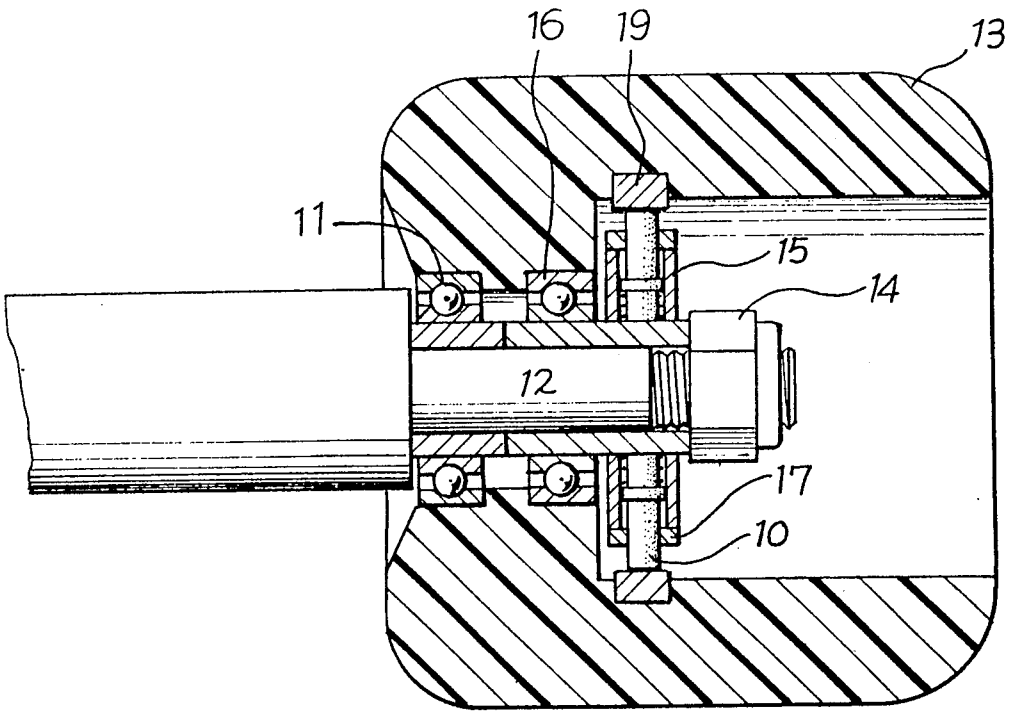
FIG. 1 is a cross-sectional view of a spark-producing mechanism in accordance with the subject of the present invention.
Figure 2:
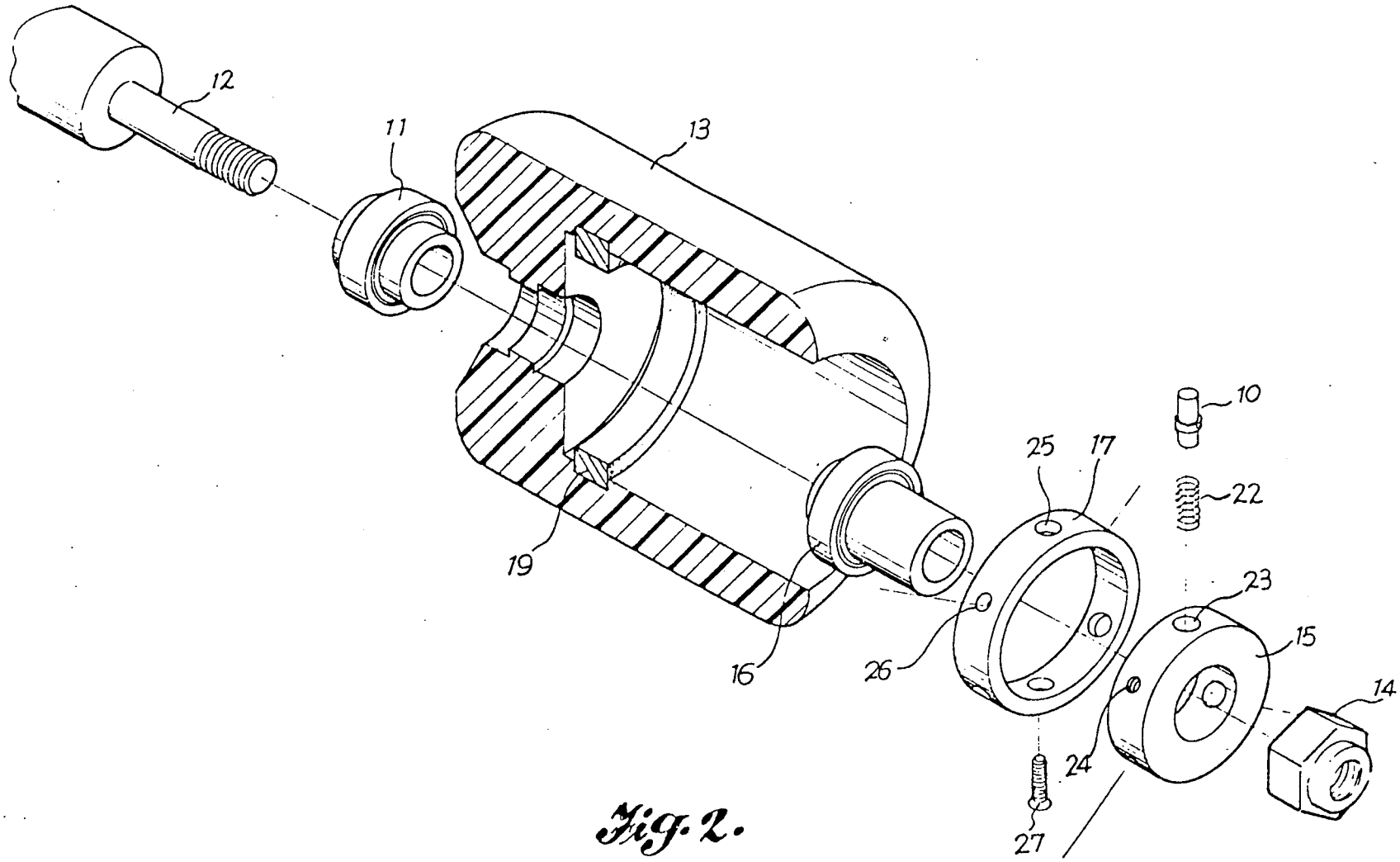
FIG. 2 is an exploded view illustrating component parts of the present invention.

Referring now to FIGS. 1 and 2, an exemplary preferred embodiment of a spark-producing mechanism for wheel assembly of the present invention is illustrated in which a first bearing (11) (its bushing has one side outwardly extended) closely fits to one extreme end of the shaft (12) of the wheel and comes into contact with the extension of the shaft (12) thereto, said shaft (12) having both ends threaded. A wheel (13) having a recess on one lateral side at the central part thereof is compactly combined with the bearing (11). A second bearing (16) also closely fits the shaft (12) of the wheel and touches the bearing (11) by means of its outwardly extending bushing. Both extensions of the bushing are joined together to form a circular zone. The wheel (13) has a inner flange so as to fit the circular zone to keep the bearings in a fixed location. There is a clearance between the flange and the bearing bushing to prevent them from touching each other. Another recess is provided opposite to the central part of the wheel (13). The bearing (16) is mounted within the wheel (13) with both ends of the bearing bushing extending outwardly and providing enough extension to make a fixing ring (15) fit closely thereto. The extended bushing of the bearing (16) closely fits the fixing ring (15) by being inserted through the inner hole of the same. There are a plurality of holes (23) and threaded holes (24) along the circumference of the fixing ring (15). Preferably, these holes are provided symmetrically. Each of the hole (23) contains a flint (10) and a spring (22). The flint (10) is substantially cylindrical and has a flange near to the bottom thereof for supporting the spring (22). A compression ring (17), providing circumferentially a plurality of holes (25, 26) with equal number corresponding to the fixing ring (15), is fitted on the outer rim of the fixing ring (15). The compression ring (17) and the fixing ring (15) are fastened to each other by a plurality of screws (27) via the holes (26). A grindstone (19), which is a circular ring, is inserted in the interior of the wheel (13) during the fabrication procedure and is adjusted in order to come into contact with the projecting flint (10). By means of rotating the wheel (13), the flint (10) rubs against the grindstone (19) to produce sparks. After abrasion, the flint (10) is pushed outward by means of the restoring force of the compression spring (22). The flint (10) can produce continuously by means of rotating the wheel (13) until the flange of the flint (10) comes into contact with the inner wall of the compression ring (17). The outside of the wheel (13) forms a concave part in the center for easy assembly and disassembly. A nut (14) screws onto the screw end of the shaft (12) of the wheel to fasten the wheel (13) into position.

Figure 3:
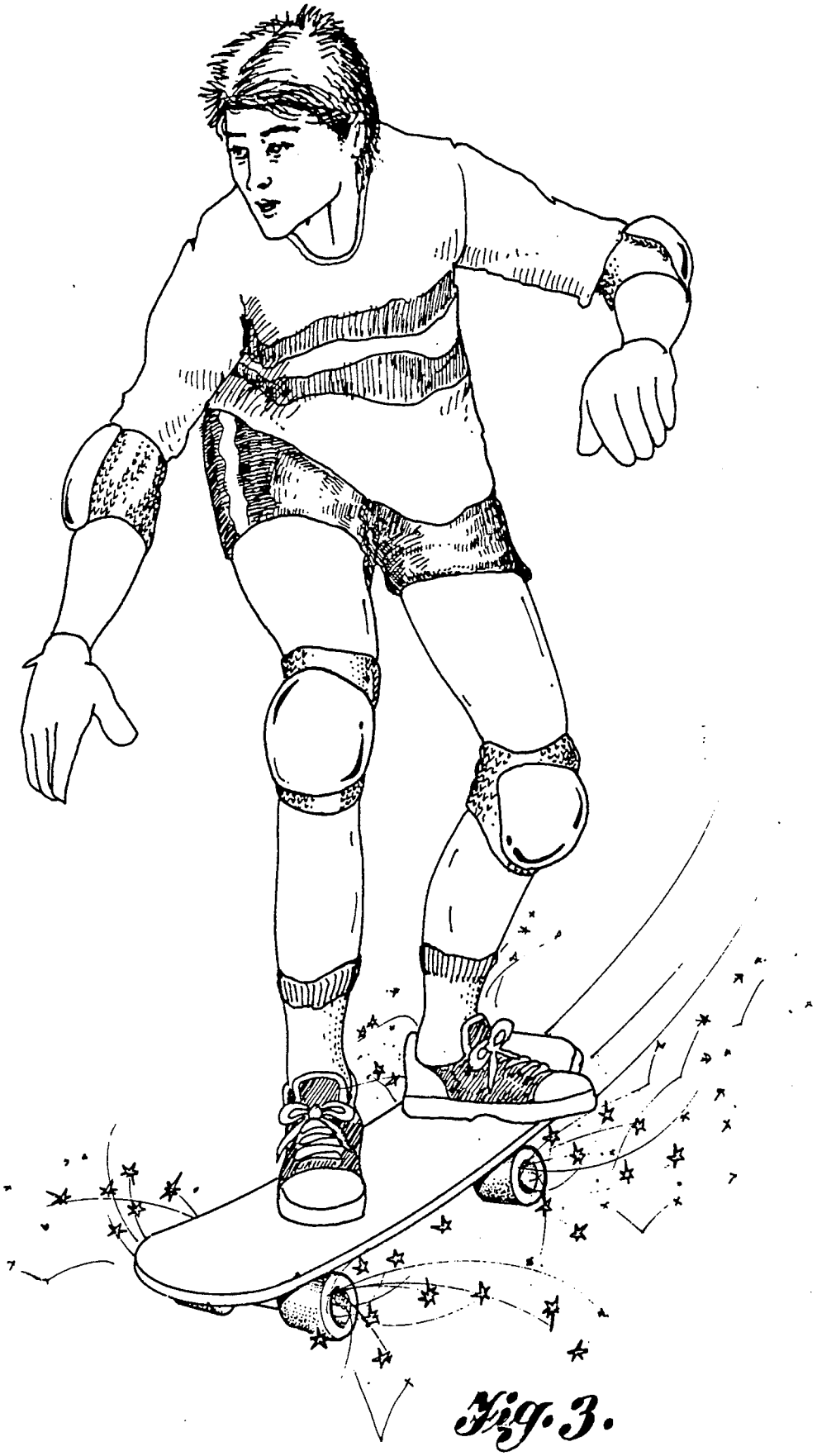
FIG. 3 is a schematic view illustrating a skateboarder moving on a skateboard in combination with the present invention.

FIG. 3 illustrates a skateboarder using a skateboard in combination with the present invention to produce sparks.

While the invention has been described with a certain degree of particularity, it is manifest that many changes may be made in the details of construction and the arrangement of components without departing from the spirit and scope of this disclosure. It is understood that the invention is not limited to the exemplified embodiment set forth herein but is to be limited only by the scope of the attached claims, including the full range of equivalency to which each element thereof is entitled.

I claim:

1. A spark-producing mechanism for a wheel assembly comprising:

a first bearing including a bushing portion fitted to a shaft having a threaded end;

a second bearing including a bushing portion fitted to said shaft adjacent said first bearing;

a wheel having a central portion and annular lip depending therefrom, said central portion serving to engage said first and second bearings;

a fixing ring fitted to the bushing portion of said second bearing, said fixing ring including a plurality of spaced apart non-through holes on a circumference thereof, each of said plurality of non-through holes having a spring means and a flint disposed partially therein, said flint being substantially cylindrical and having a flange proximate one end thereof, said flint flange serving to support said spring means;

a compression ring mounted on said fixing ring circumference, said compression ring including a plurality of spaced apart through holes, each of said through holes being spaced apart in a manner corresponding to the spacing of said fixing ring non-through holes, whereby said flints may operationally pass therethrough;

a grindstone mounted to an interior surface of said wheel annular lip; and a nut screwed onto said shaft threaded end, said nut serving to fasten said wheel in position;

said spring means serving to urge said flints in a radially outward direction into contact with said grindstone whereby said flints rub against said grindstone to produce sparks during rotation of said wheel until the flanges of said flints come into contact with said compression ring.

* * * * *